US009275768B2

(12) United States Patent
Wegeler et al.

(10) Patent No.: US 9,275,768 B2
(45) Date of Patent: Mar. 1, 2016

(54) TRANSPORT CONTAINER FOR NUCLEAR FUEL ASSEMBLY AND METHOD OF TRANSPORTING A NUCLEAR FUEL ASSEMBLY

(75) Inventors: Pierre Wegeler, Villieu (FR); Jacques Gauthier, Cailloux sur Fontaines (FR)

(73) Assignee: AREVA NP, Courbevoie (FR)

( * ) Notice: Subject to any disclaimer, the term of this patent is extended or adjusted under 35 U.S.C. 154(b) by 9 days.

(21) Appl. No.: 12/810,483

(22) PCT Filed: Dec. 22, 2008

(86) PCT No.: PCT/FR2008/052400

§ 371 (c)(1),
(2), (4) Date: Jun. 24, 2010

(87) PCT Pub. No.: WO2009/081078

PCT Pub. Date: Jul. 2, 2009

(65) Prior Publication Data

US 2010/0284778 A1 Nov. 11, 2010

(30) Foreign Application Priority Data

Dec. 26, 2007 (FR) ..... 07 60368

(51) Int. Cl.
*G21F 5/008* (2006.01)

(52) U.S. Cl.
CPC ..... *G21F 5/008* (2013.01); *G21Y 2002/301* (2013.01); *G21Y 2002/304* (2013.01); *G21Y 2002/305* (2013.01); *G21Y 2004/30* (2013.01)

(58) Field of Classification Search
CPC ..... G21F 5/008
USPC ..... 376/272; 250/506.1, 507.1
See application file for complete search history.

(56) References Cited

U.S. PATENT DOCUMENTS 3,391,280 A * 7/1968 Bonilla et al. ..... 376/272
3,466,662 A * 9/1969 Blum ..... 376/272

(Continued)

FOREIGN PATENT DOCUMENTS

DE 2942092 A1 4/1981
DE 199 08 490 A1 9/2000

(Continued)

OTHER PUBLICATIONS

Moujaes et al., Abstract to "Thermal considerations in vertically emplaced high level nuclear waste containers", Proceedings of the Fifth International Conference on Radioactive Waste Management and Environmental Remediation, ICEM'95, vol. 1, pp. 867-871, publ.: ASME. ISBN: 0791812197 (New York, USA).*

(Continued)

*Primary Examiner* — Jack W Keith
*Assistant Examiner* — Daniel Wasil
(74) *Attorney, Agent, or Firm* — Davidson, Davidson & Kappel, LLC

(57) ABSTRACT

A container for a non-irradiated nuclear fuel assembly including a single casing for receiving at least one nuclear fuel assembly, the casing being formed from an elongate tubular shell, the shell including a metallic internal layer delimiting at least one individual housing for receiving a nuclear fuel assembly, and a metallic external layer surrounding the internal layer, the shell being filled between its internal layer and its external layer, and from lids for closing the or each housing at the longitudinal ends of the shell.

18 Claims, 11 Drawing Sheets

(56) References Cited

U.S. PATENT DOCUMENTS

| | | | | | |
|---|---|---|---|---|---|
| 3,575,601 | A * | 4/1971 | Lindsay et al. | 376/272 |
| 3,732,427 | A * | 5/1973 | Trudeau et al. | 376/272 |
| 3,962,587 | A * | 6/1976 | Dufrane et al. | 376/272 |
| 4,116,337 | A * | 9/1978 | Backus | 376/272 |
| 4,121,106 | A * | 10/1978 | Terhune et al. | 376/154 |
| 4,156,147 | A * | 5/1979 | Naum et al. | 376/272 |
| 4,289,716 | A * | 9/1981 | Voigt | 264/45.9 |
| 4,292,528 | A * | 9/1981 | Shaffer et al. | 376/272 |
| 4,437,013 | A * | 3/1984 | Hondorp | 250/515.1 |
| 4,498,011 | A * | 2/1985 | Dyck et al. | 376/272 |
| 4,535,250 | A * | 8/1985 | Fields | 250/507.1 |
| 4,861,205 | A * | 8/1989 | Wozniak et al. | 376/272 |
| 5,263,064 | A * | 11/1993 | Sappey | 376/272 |
| 5,550,882 | A * | 8/1996 | Lehnert et al. | 376/272 |
| 5,715,289 | A * | 2/1998 | Kirchner et al. | 376/272 |
| 5,894,134 | A * | 4/1999 | Kissinger | 376/272 |
| 5,995,573 | A * | 11/1999 | Murray | 376/272 |
| 6,328,524 | B1 * | 12/2001 | Johnston | 414/460 |
| 6,580,085 | B1 * | 6/2003 | Gaucherand | 376/272 |
| 6,748,042 | B1 * | 6/2004 | Stilwell et al. | 376/272 |
| 6,825,483 | B2 * | 11/2004 | Nicholson et al. | 376/272 |
| 7,327,821 | B2 * | 2/2008 | Ishihara et al. | 376/272 |
| 8,259,892 | B2 * | 9/2012 | Gauthier et al. | 376/272 |
| 2002/0121143 | A1 * | 9/2002 | Soriano | 73/856 |
| 2003/0147485 | A1 * | 8/2003 | Wright et al. | 376/272 |
| 2006/0219960 | A1 | 10/2006 | Shimojo et al. | |
| 2008/0203327 | A1 * | 8/2008 | Hempy et al. | 250/506.1 |
| 2009/0304137 | A1 * | 12/2009 | Bersegol et al. | 376/272 |

FOREIGN PATENT DOCUMENTS

| | | | | |
|---|---|---|---|---|
| DE | 19908490 | A1 * | 9/2000 | G21F 5/00 |
| FR | 2774800 | | 8/1999 | |
| JP | S57-160699 | | 10/1982 | |
| JP | S62-161094 | | 7/1987 | |
| JP | H07-280990 | | 10/1995 | |
| JP | H09-113687 | | 5/1997 | |
| JP | H10-246796 | | 9/1998 | |
| JP | H10-268081 | | 10/1998 | |
| WO | WO 01/22430 | A1 | 3/2001 | |
| WO | WO-2007017519 | A1 * | 2/2007 | G21F 5/14 |

OTHER PUBLICATIONS

Hammond, C.R., "The Elements", CRC Handbook of Chemistry and Physics, 94th Edition (20313-2014), pp. 4-1 through 4-42.*

*Fact Sheet: Nuclear Fuel Cycle Transport: Packages Types used for Transporting Radioactive Materials*, World Nuclear Transport Institute (2013).

*Fact Sheet: Quick facts on the transport of Nuclear Fuel Cycle Transport*, World Nuclear Transport Institute (2013).

*Fact Sheet: Nuclear Fuel Cycle Transport: Front End Materials*, World Nuclear Transport Institute (2013).

*Fact Sheet: Nuclear Fuel Cycle Transport: Back End Materials*, World Nuclear Transport Institute (2013).

*Standard Review Plan for Transportation Packages for Radioactive Material*, U.S. Nuclear Regulatory Commission, Office of Nuclear Material Safety and Safeguards (1999).

*Standard Review Plan for Transportation Packages for Spent Nuclear Fuel*, U.S. Nuclear Regulatory Commission, Office of Nuclear Material Safety and Safeguards (2000).

*Le transport de matieres radioactives*, Institut de Radioprotection et de Sûreté Nucléaire (2007); also includes verified English translation of portions of pp. 14, 15 and 18.

* cited by examiner

TRANSPORT CONTAINER FOR NUCLEAR FUEL ASSEMBLY AND METHOD OF TRANSPORTING A NUCLEAR FUEL ASSEMBLY

The present invention relates to a transport container for a non-irradiated nuclear fuel assembly.

BACKGROUND

New (or non-irradiated) nuclear fuel assemblies are generally manufactured at a production site and then transported to a nuclear power station.

During transport, the nuclear fuel assemblies have to be protected in order to preserve their integrity under normal transport conditions, for the purpose of ensuring their later use in a nuclear reactor under the required conditions of safety and performance, and in order to minimize the risk of malfunction in the event of an accident in the course of transport, in particular in order to avoid dispersing fissile material and approaching conditions of criticality.

FR 2 774 800 describes a transport container for nuclear fuel assemblies comprising internal packaging delimiting two individual housings for nuclear fuel assemblies, and external packaging formed from two half-shells, the internal packaging being suspended inside the external packaging.

The object of that arrangement is to protect new nuclear fuel assemblies from impact and vibration thanks to the two nested packagings and to the means of suspension between the two packagings.

Nevertheless, that container is particularly bulky and heavy. It can be stored only horizontally on the ground and the large surface area which it occupies on the ground limits the number of containers which can be stored intermediately at the site of a nuclear power station. Its large dimensions force operators to work high above the ground, for example in order to lash down the container on a transport platform. Finally, a large number of journeys is necessary to ensure the delivery of the fuel in compliance with regulations. Those characteristics increase the cost of transporting and exploiting that type of container considerably.

SUMMARY OF THE INVENTION

An object of the present invention is to provide a transport container for a nuclear fuel assembly which enables the transport costs to be reduced considerably and the conditions of exploitation thereof to be improved.

To that end, the invention provides a transport container for a non-irradiated nuclear fuel assembly, characterized in that it comprises a single casing for receiving at least one nuclear fuel assembly, the casing being formed from an elongate tubular shell, the shell comprising a metallic internal layer delimiting at least one individual housing for receiving a nuclear fuel assembly, and a metallic external layer surrounding the internal layer, the shell being filled between its internal layer and its external layer, and from lids for closing the or each housing at the longitudinal ends of the shell.

According to other embodiments, the container comprises one or more of the following features, taken individually or in accordance with any technically possible combination:

- it comprises lateral faces which delimit the or each individual housing and which are substantially smooth over the entire length of the housing;
- the transverse clearance between lateral faces of the or each individual housing and an assembly which is to be received inside the housing is selected in such a manner that damage to the assembly caused by relative movement in the housing is avoided;
- the transverse clearance between the lateral faces of the or each individual housing and an assembly which is to be received inside the housing is from 0.1 to 5 mm, preferably from 0.3 to 3 mm, and even more preferably from 0.5 to 1 mm;
- the transverse clearance is adjusted by adding plates which are secured to the internal surfaces of the housings;
- the or each housing has a quadrangular cross-section defined by two pairs of lateral faces arranged in the shape of a V, the shell comprising for the or each housing a support carrying one of the pairs of lateral faces arranged in the shape of a V, a door carrying the other of the two pairs of lateral faces arranged in the shape of a V, and means for securing the door to the support enabling the position of the door and the support to be adjusted in the transverse direction passing via the lines of intersection of the pairs of faces arranged in the shape of a V;
- the shell comprises an intermediate layer for neutrophage insulation and an intermediate layer for protection against impact;
- a layer for thermal protection is added to the layer for protection against impact;
- the protective layer surrounds the neutrophage insulation layer; and
- the shell comprises an intermediate metallic separation layer separating the neutrophage insulation layer and the protective layer.

The invention also provides a method of transporting at least one nuclear fuel assembly, wherein at least one non-irradiated nuclear fuel assembly is placed in a container such as defined above, the container is placed on a transport vehicle in such a manner that the casing of the container protects by itself the nuclear fuel assembly in the event of the container falling, and the container is transported from a first site to a second site.

According to one embodiment, suspension members are arranged between the shell and a deposit surface.

BRIEF DESCRIPTION OF THE DRAWINGS

The invention and its advantages will be better understood on reading the following description which is given purely by way of example and with reference to the appended drawings, in which.

DETAILED DESCRIPTION

Figure 1:
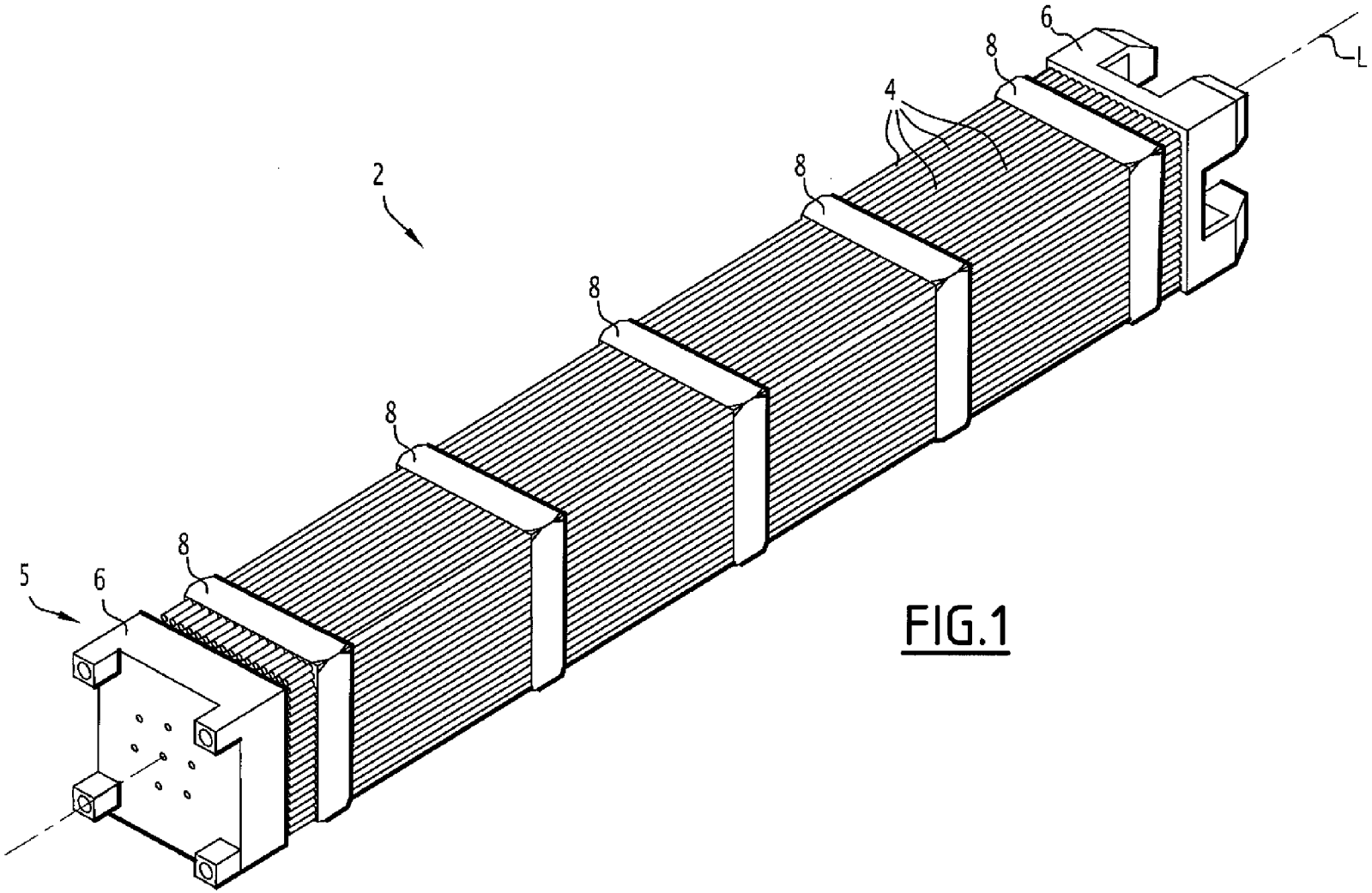
FIG. 1 is a diagrammatic perspective view of a nuclear fuel assembly.

The nuclear fuel assembly 2 of FIG. 1 is of the type which is to be used in pressurized light water nuclear reactors (PWR).

The assembly 2 is elongate in a longitudinal direction L. It comprises a bundle of nuclear fuel rods 4, and a framework 5 for supporting the rods 4. The assembly 2 has a square cross-section in the example illustrated.

The rods 4 are in the form of tubes which are filled with nuclear fuel pellets and which are closed at their ends by plugs.

As is conventional, the framework 5 comprises two end-pieces 6 arranged at the longitudinal ends of the assembly 2, guide tubes (not shown) extending longitudinally between the end-pieces 6, and grids 8 for holding the rods 6. The guide tubes are secured at their ends to the end-pieces 6. The grids 8 are secured to the guide tubes and distributed between the end-pieces 6. The rods 4 extend through the grids 8 which hold them longitudinally and transversely.

The nuclear fuel assemblies are generally manufactured at a manufacturing site and then transported to a nuclear power station where they are stored intermediately before being introduced into the core of a nuclear reactor.

Figure 2:
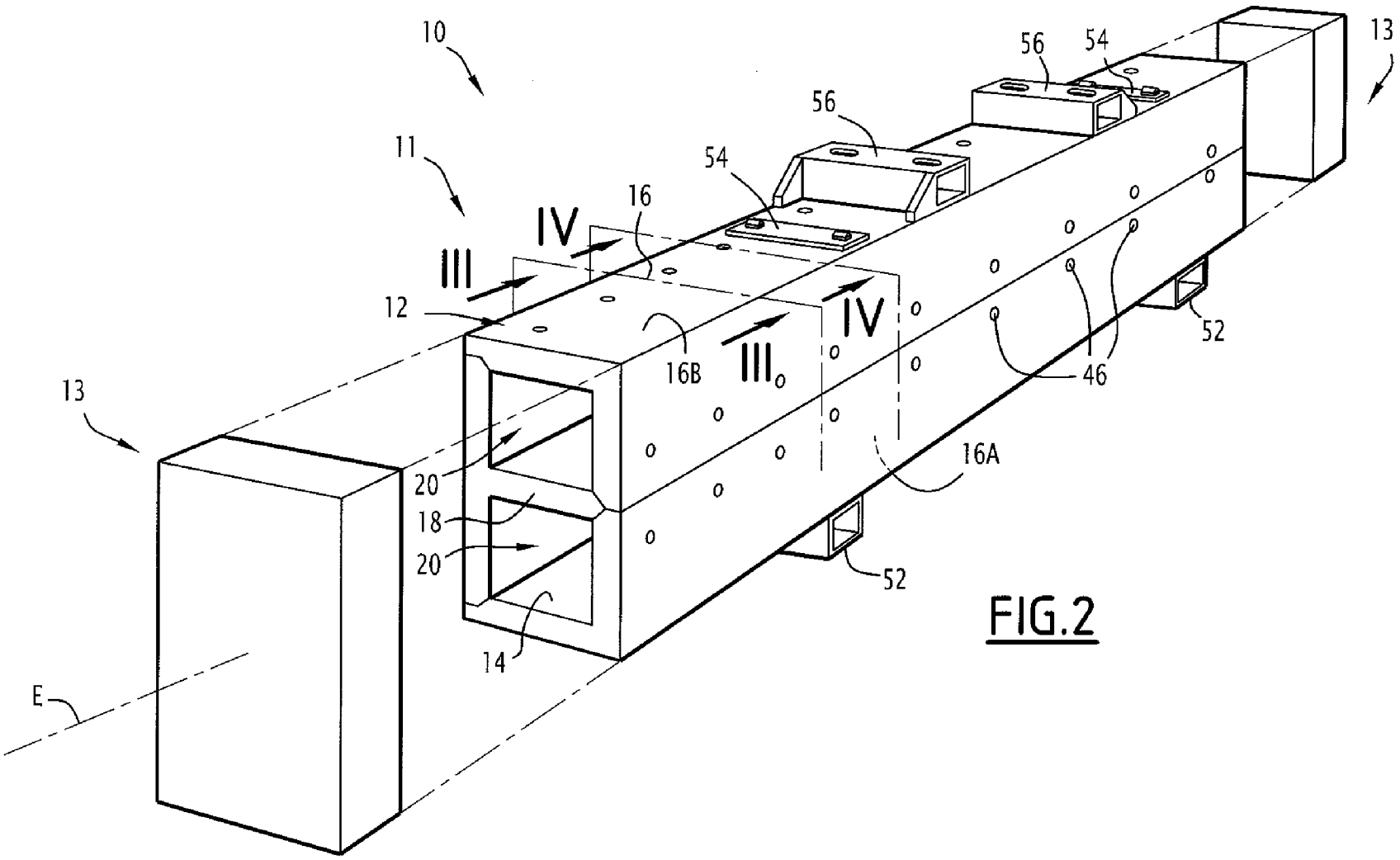
FIG. 2 is a perspective view of a container according to the invention, provided for transporting two nuclear fuel assemblies according to FIG. 1.

FIG. 2 illustrates a container 10 according to the invention enabling the assembly 2 to be transported from a manufacturing site to a nuclear power station.

The container 10 comprises a single casing 11 for receiving nuclear fuel assemblies, the casing 11 being formed from a shell 12 and two lids 13.

The shell 12 is tubular and longitudinally elongate in a longitudinal direction E. It has an internal surface 14 delimiting an internal cavity, and an external surface 16.

The shell 12 comprises a longitudinal partition 18 separating the internal cavity of the shell 12 into two distinct and separate individual housings 20. The housings 20 extend parallel with each other one on each side of the partition 18, in the longitudinal direction E of the shell 12.

Each housing 20 is to receive a nuclear fuel assembly 2 such as that of FIG. 1, and has a corresponding cross-section, here a square cross-section.

Each housing 20 can, if necessary, receive a rod case containing fuel rods which are to be assembled to form fuel assemblies, or which are to be used to repair previously delivered fuel assemblies.

The lids 13 are provided to close the housings 20 at the longitudinal ends of the shell 12.

As is conventional, each lid 13 comprises metallic plates enclosing an energy-dissipating material, such as balsa wood, a foam or a honeycomb structure. The lids 13 form devices for dissipating energy in the event of the container 10 falling axially.

By way of variation, they have an internal structure similar to that of the shell 12, which is described hereinafter.

Figure 3:
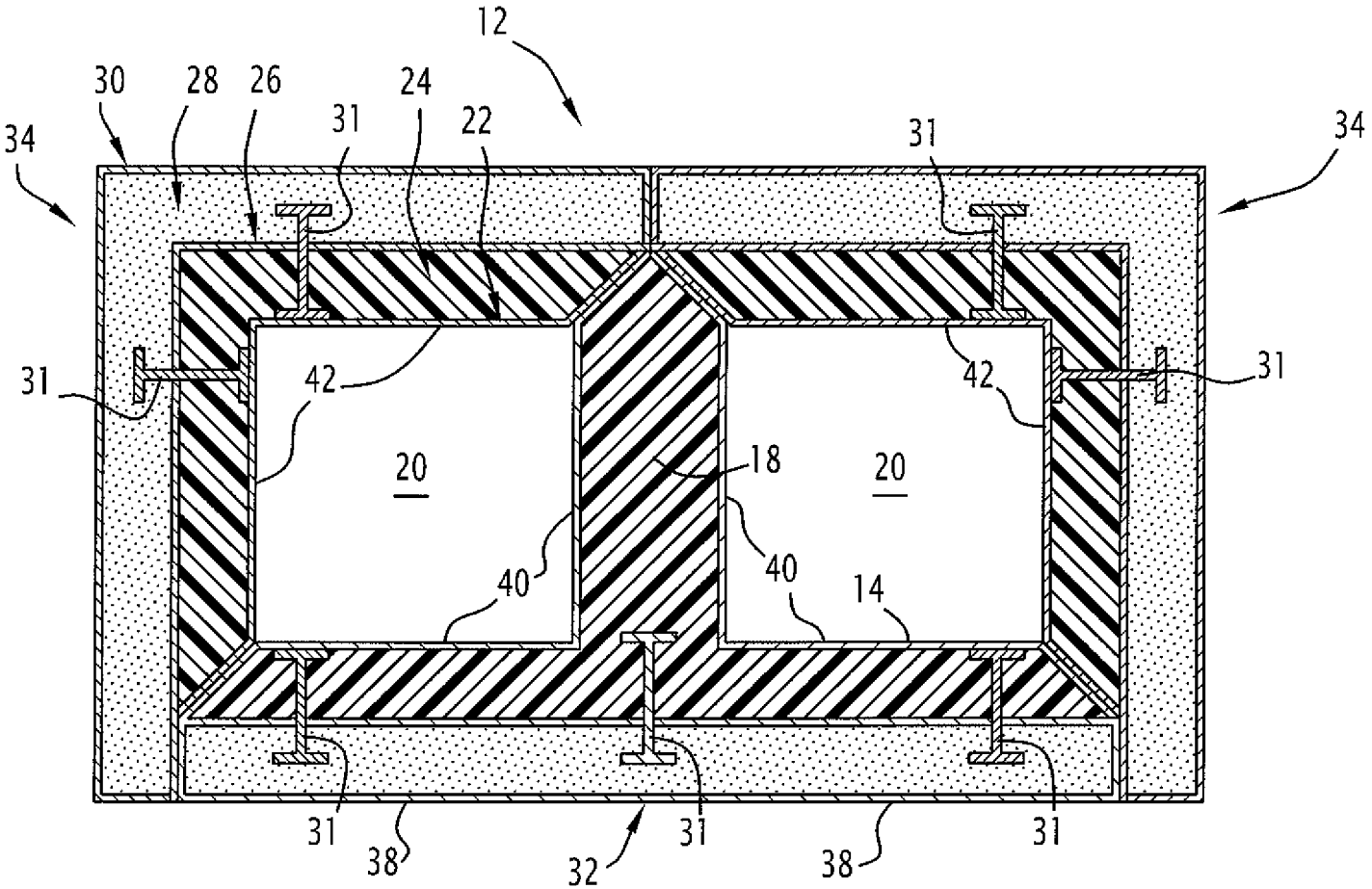
FIGS. 3 and 4 are sectional views of the container of FIG. 2, in accordance with the planes III-III and IV-IV, respectively.
Figure 4:
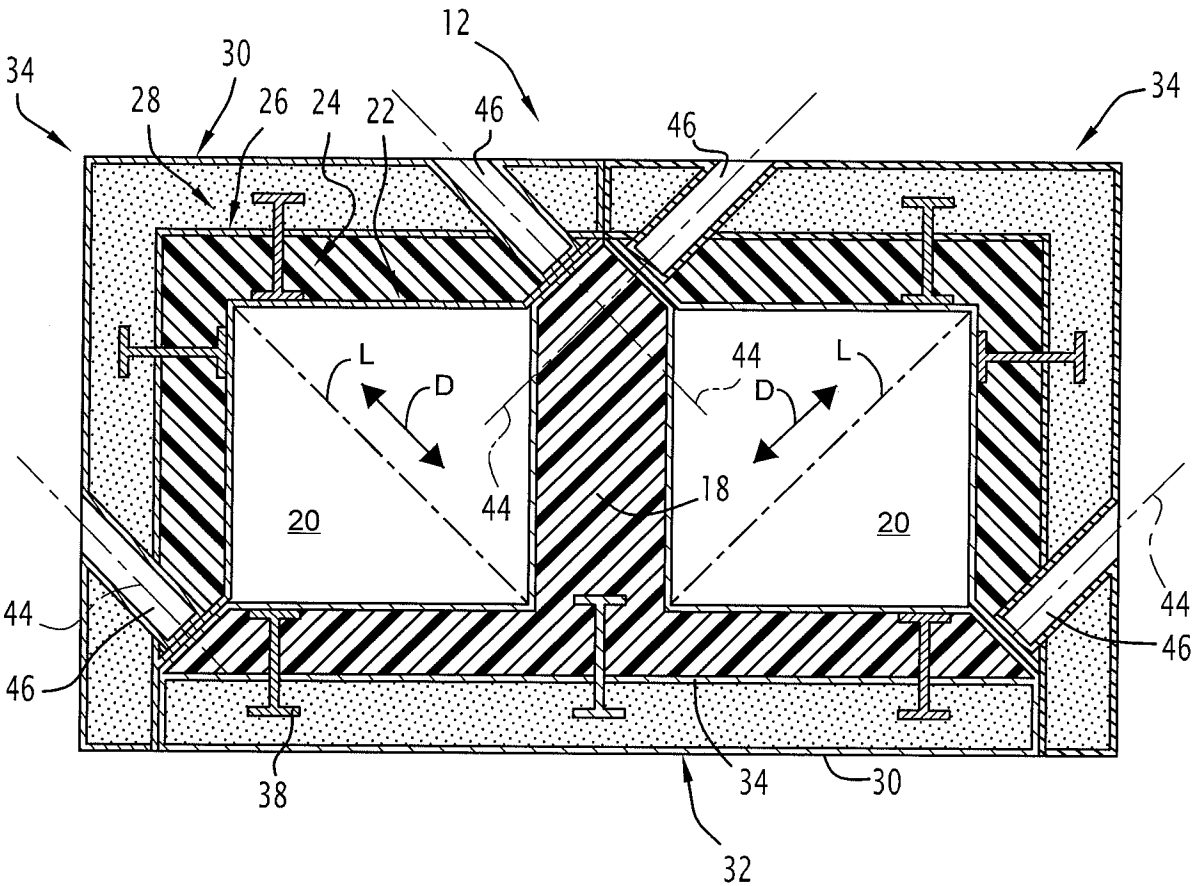

The internal structure of the shell 12 is illustrated in FIGS. 3 and 4 which are cross-sectional views of the shell 12.

As shown in FIG. 3, the shell 12 is layered and comprises several superposed layers.

To be more precise, it comprises, from the inside to the outside of the shell 12, a metallic internal layer 22, a neutron insulating layer 24, a metallic intermediate layer 26, a protective layer 28 and a metallic external layer 30.

The intermediate layers 24, 26 and 28 fill the shell 12 between the internal layer 22 and the external layer 30, substantially without leaving a gap.

The internal layer 22 defines the housings 20. The external layer 30 defines the external skin of the shell 12. The intermediate layer 26 separates the insulating layer 24 and the protective layer 28.

The protective layer 28 is to absorb the energy of violent mechanical impact and to insulate the fuel assemblies 2 thermally with respect to the outside. It is preferably solid in order to contribute to the mechanical strength of the shell 12. It is formed, for example, by a high-density foam or by balsa wood.

The insulating layer 24 is a neutrophage layer which is to absorb neutrons emitted by nuclear fuel assemblies received in the housings 20. It is preferably solid in order to contribute to the mechanical strength of the shell 12. The insulating layer 24 is, for example, a resin which is charged with a neutrophage chemical compound or element, such as boron, and which is rich in hydrogen, or is a sheet of neutron-absorbing metallic material, such as hafnium.

In a variant of the invention, the layers 22, 24 and 26 are replaced by a single thick metallic internal layer composed, for example, of boron steel or boron aluminium (a few % boron by mass).

The shell 12 optionally comprises reinforcing members 31, here in the form of longitudinal beams arranged in the thickness of the shell 12, between the internal layer 22 and the external layer 30. The reinforcing members 31 are, for example, metal profiles having an "I"-shaped cross-section, one foot of which is secured to the internal layer 22 and the core of which extends radially towards the outside.

Other suitable means of mechanical reinforcement may be envisaged. Thus, by way of variation or optionally, internal reinforcing members are provided in the form of flat profiles, tubes, angled members or corrugated metal sheets which are each placed between two metallic layers, for example between the metallic intermediate layer 26 and the metallic external layer 30 and/or between the metallic internal layer 22 and the metallic intermediate layer 26, and fixedly joined, for example by welding, thereto.

By way of variation or optionally, the shell 12 comprises members for reinforcing the external layer, for example in the form of ribs projecting from the external layer towards the outside of the shell 12. The ribs are integral with the external layer 30 or are attached thereto.

The shell 12 is formed from several shell portions which are elongate in the longitudinal direction E.

To be more precise, the shell 12 is formed by a first shell portion forming a support 32 having a cross-section in the shape of a "T" and a second shell portion formed by two doors 34 having a cross-section in the shape of an "L".

The support 32 comprises the partition 18 defining the down-stroke of the "T" and two wings 38 extending symmetrically one on each side of the partition 18 and defining the cross stroke of the "T". The partition 18 is formed by a rib of a portion of the internal layer 22 filled with the material of the insulating layer 24 of the wings 38. As a result, the housings 20 are separated by a neutron insulating layer, which prevents the initiation of a nuclear reaction between two nuclear fuel assemblies 2 located in the housings 20.

Each door 34 is secured to one end of the partition 18 and to one end of a wing 38. Each housing 20 is defined by two faces 40 of the support 32 forming a V at 90°, and two faces 42 of one of the doors 34, forming a V at 90°. One of the faces 40 of the support 32 is a face of the partition 18, and the other a face of a wing 38.

The faces 40 and 42 are smooth over the entire length of the housing 20. They define a cross-section corresponding substantially to that of the end-pieces 6 and the grids 8 of the assembly 2 of FIG. 1 which are to be received in the housings 20.

The total lateral clearance between the faces 40, 42 and the grids 8 is from 0.1 to 5 mm, preferably from 0.3 to 3 mm, even more preferably from 0.5 to 1 mm, in order to avoid relative displacement of the assembly 2 in the housing 20, the amplitude of which would damage the assembly received in the housing, while at the same time permitting the longitudinal insertion of the assembly 2 into the housing 20.

The container 10 is free from means for the transverse clamping of the assemblies 2 inside the housings 20. The small clearance existing between the assembly 2 and the housing 20 enables the amplitude of the relative movement between the assembly 2 and the housing 20 to be limited and the integrity of the assembly 2 to be preserved.

In addition, it is possible to provide for a slight clamping of the assemblies 2 inside the housings 20 owing to the cooperation between the support 32 and the doors 34.

To that end, as shown in FIG. 4 which illustrates a cross-sectional view in a plane different from that of FIG. 3, the shell 12 comprises means for securing each door 34 to the support 32 by clamping in a direction D substantially parallel with the a straight line L passing via the vertex of the V defined by the faces 42 of the door 34 and the vertex of the V defined by the faces 40 of the support 32. The securing members comprise, for example, screws 44 shown diagrammatically in FIG. 4. Resilient supports, for example of rubber, may be provided in the areas of contact between the doors 34 and the support 32.

The external layer 30 comprises wells 46 extending from the external surface 16 as far as the internal layer 22, for the passage of the screws 44. The wells 46 advantageously form reinforcing stays extending between the external layer 30 and the internal layer 22.

Figure 11:
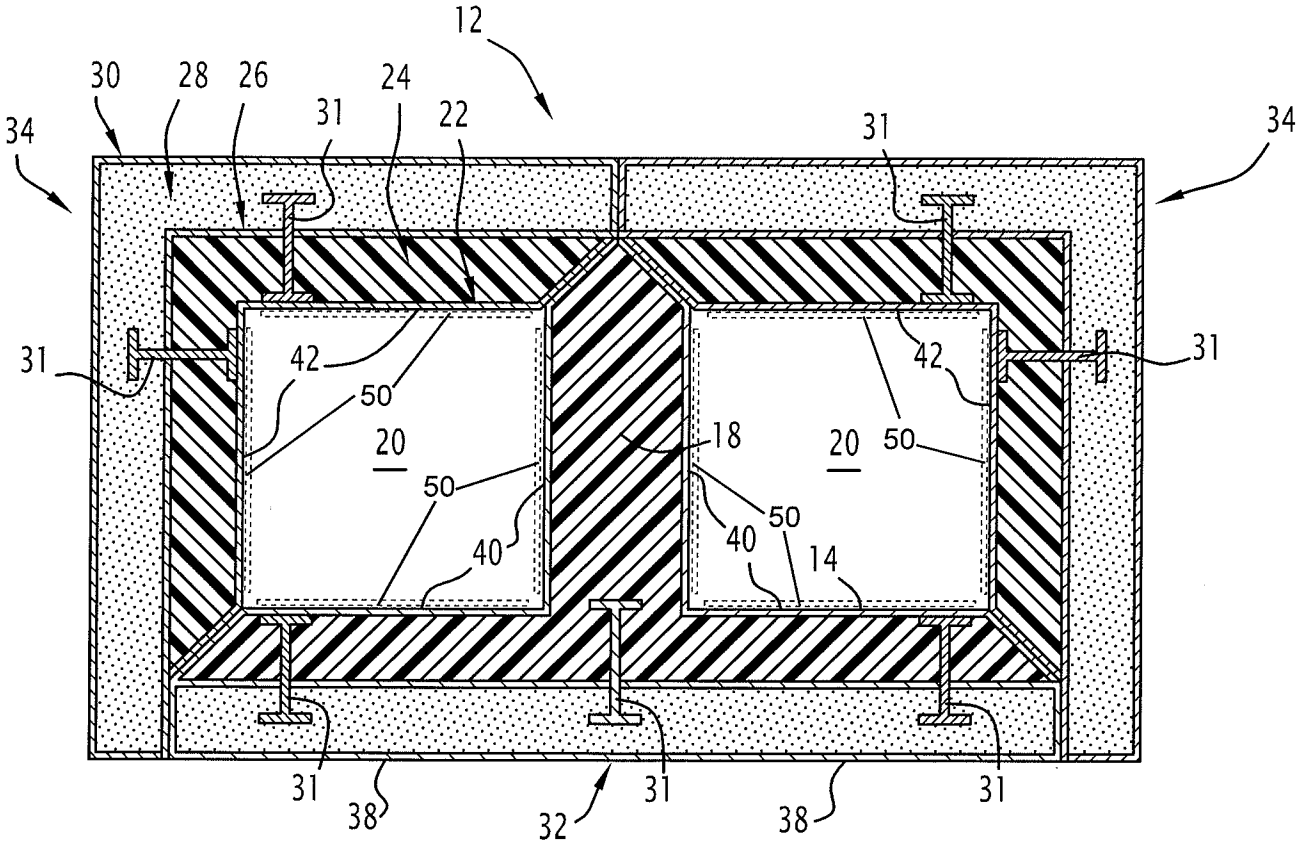
FIG. 11 is a sectional view of a container according to one alternative embodiment of the present invention.

As schematically shown for example in FIG. 11, it is possible to adjust the size of the housing 20 by adding schematically shown adjusting plates 50 of suitable thickness to one or more of the lateral faces 40, 42 of the housings 20 in order to permit the transport of fuel assemblies of different sizes.

Optionally, the upper lid 13 comprises a device for the longitudinal clamping of the assembly in order to avoid any displacement of the assembly in the longitudinal direction L of the assembly 2 in the housing 20 after positioning the upper lid 13 and closing the container 10 and during all handling and transport operations.

Figure 5:
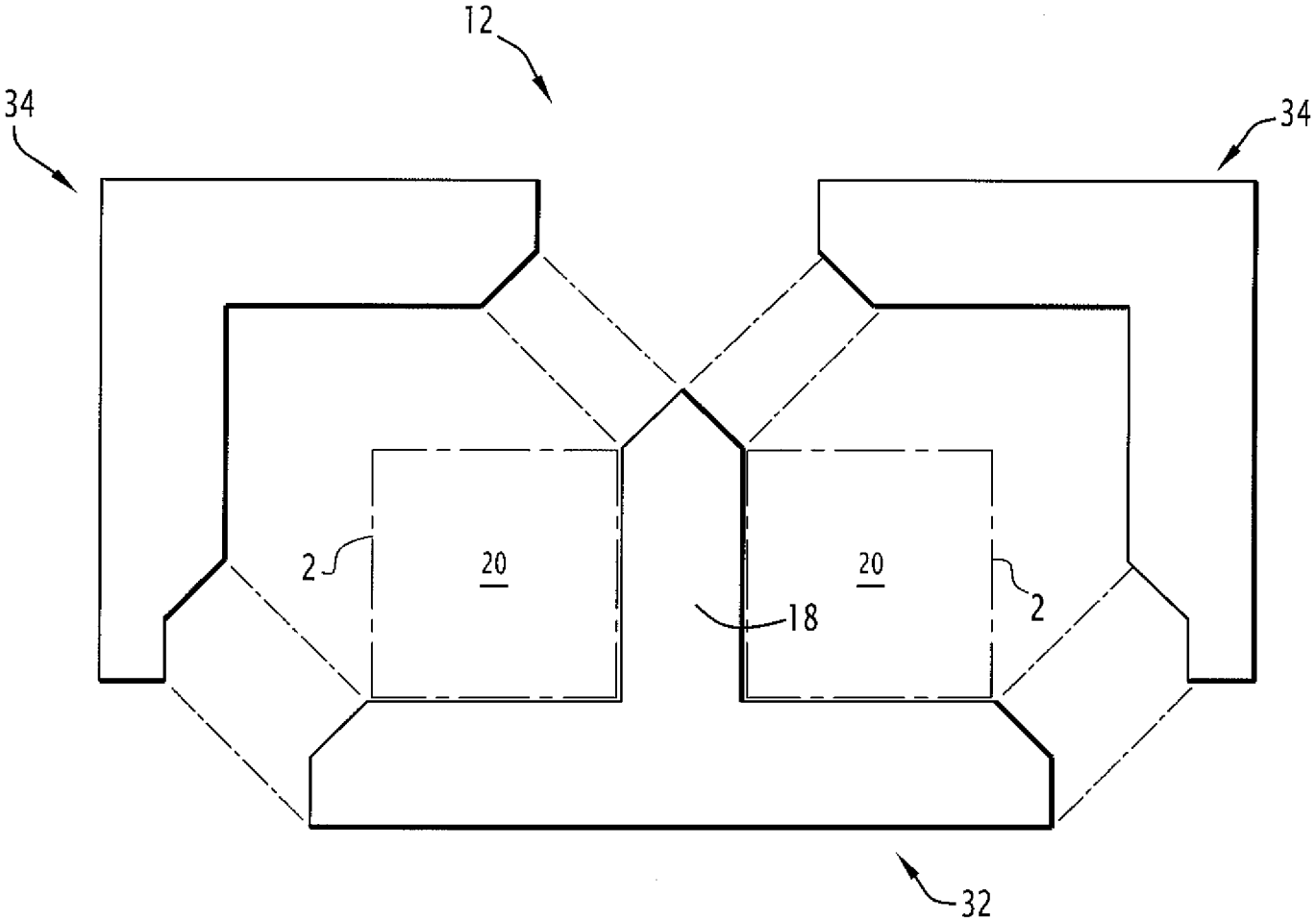
FIGS. 5 and 6 are views of the container of FIG. 2 illustrating two methods of loading the container.

As shown in FIG. 5 which illustrates an end view of the shell 12, the loading of assemblies 2 can be effected by placing the support 32 on the ground, disengaging the doors 34, placing the assemblies 2 on the support 32, then reclosing the doors 34 and clamping them on the support 32. The lids 13 may or may not be withdrawn, depending on the individual case, in order to effect this loading. Unloading can be carried out in the same manner.

The small surface area occupied on the ground and the small bulk of the container facilitates the exploitation thereof. This variant of loading and unloading while the container 10 is in the horizontal position will, however, for the most part be used for rod cases.

Figure 6:
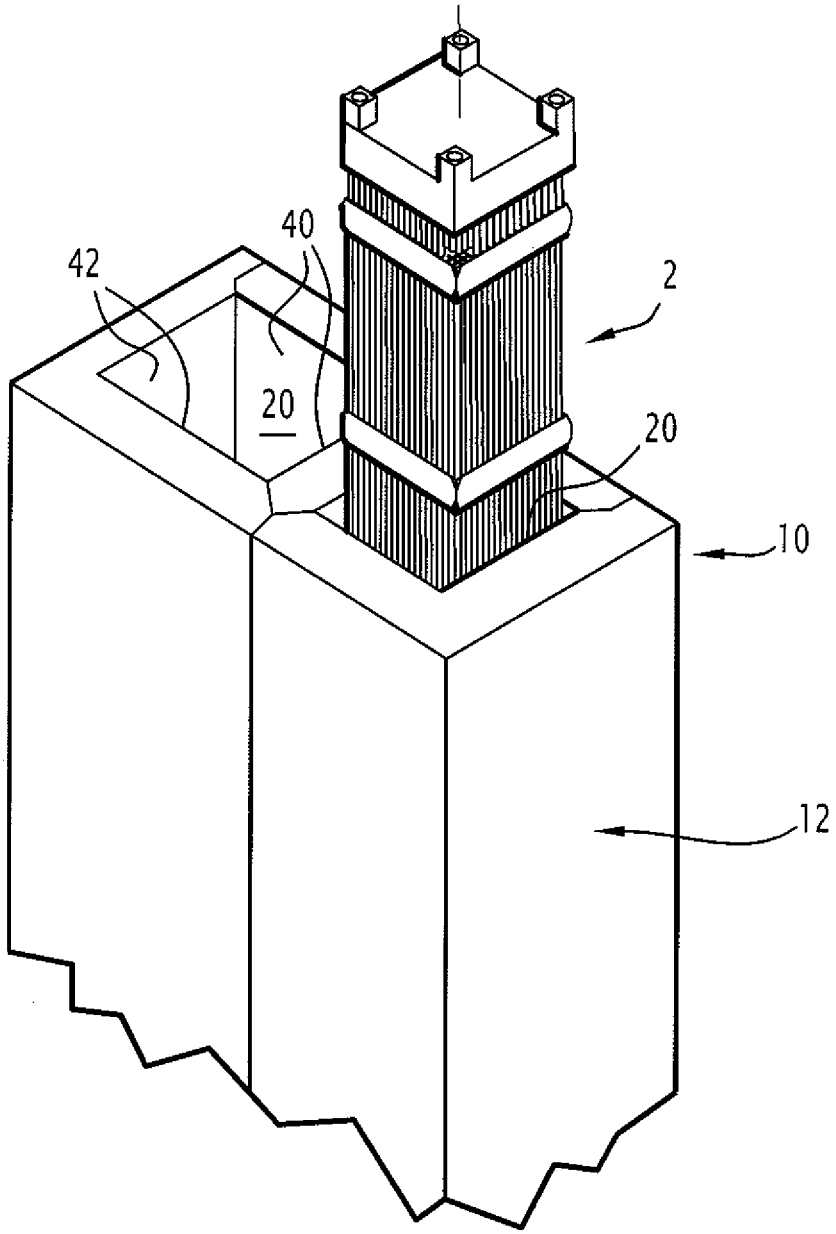

As shown in FIG. 6 which represents a perspective view, the loading or unloading of assemblies 2 can be effected by placing the container 10 in the vertical position, the support 32 being arranged against a wall or a support structure, the upper lid 13 being withdrawn, by gripping the assembly 2 by its upper end-piece 6, in known manner with appropriate lifting grippers, and by displacing the assembly 2 vertically in one of the housings 20.

This is possible owing to the fact that the lateral faces 40, 42 are substantially smooth over the entire length and there is therefore no risk of the assembly 2 catching on a raised portion inside the housing 20. This method of loading or unloading permits a major space saving because it avoids storing the container 10 in a horizontal position, and a major time saving because it avoids removing the doors 34: only the upper lid 13 has to be removed.

Figure 7:
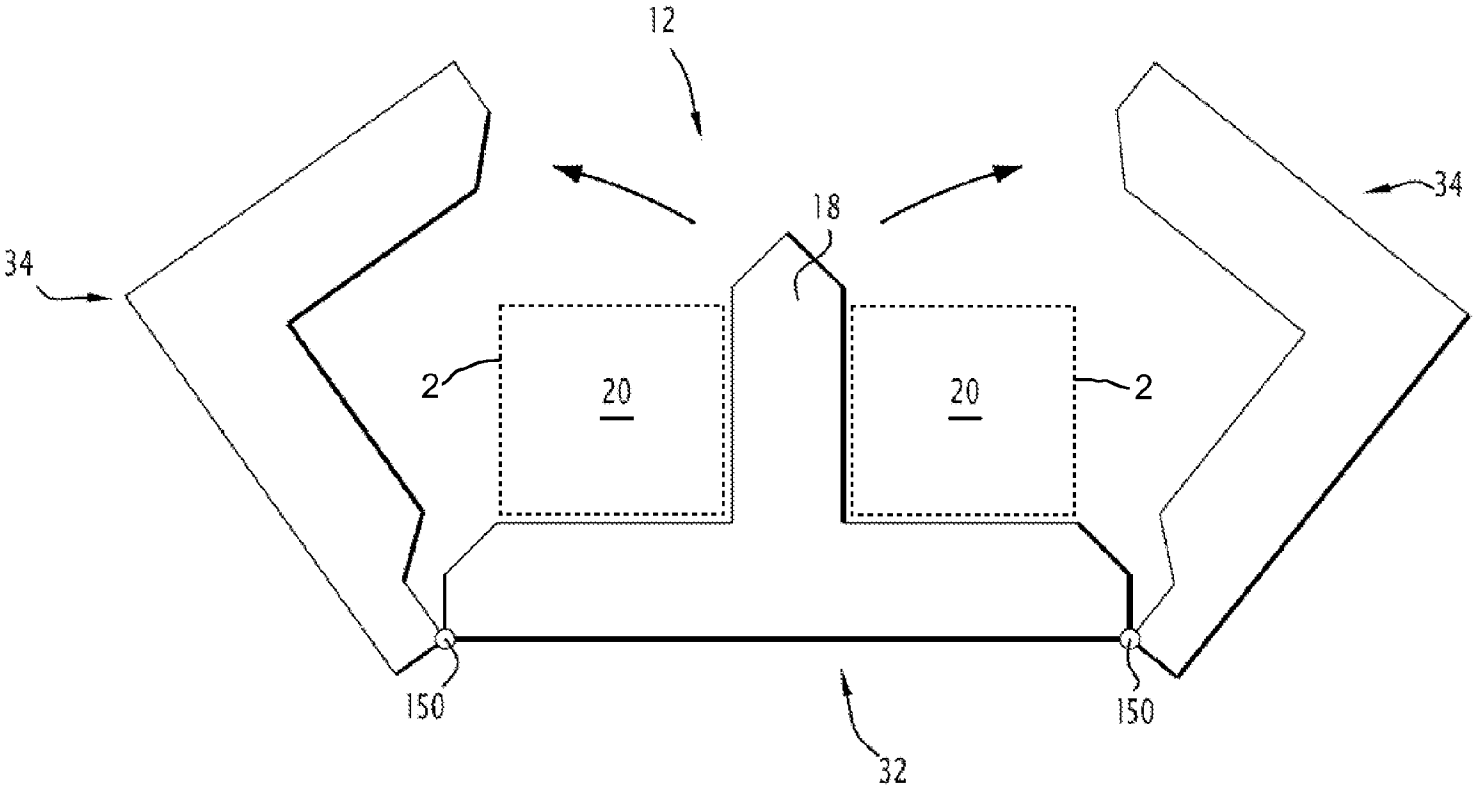
FIGS. 7 and 8 are views similar to those of FIGS. 5 and 6, illustrating the loading of a container according to a variant of the invention.

In a variant illustrated in FIG. 7, the doors 34 are articulated on the wings 38 of the support 32 by way of hinges 150 having longitudinal axes.

Figure 8:
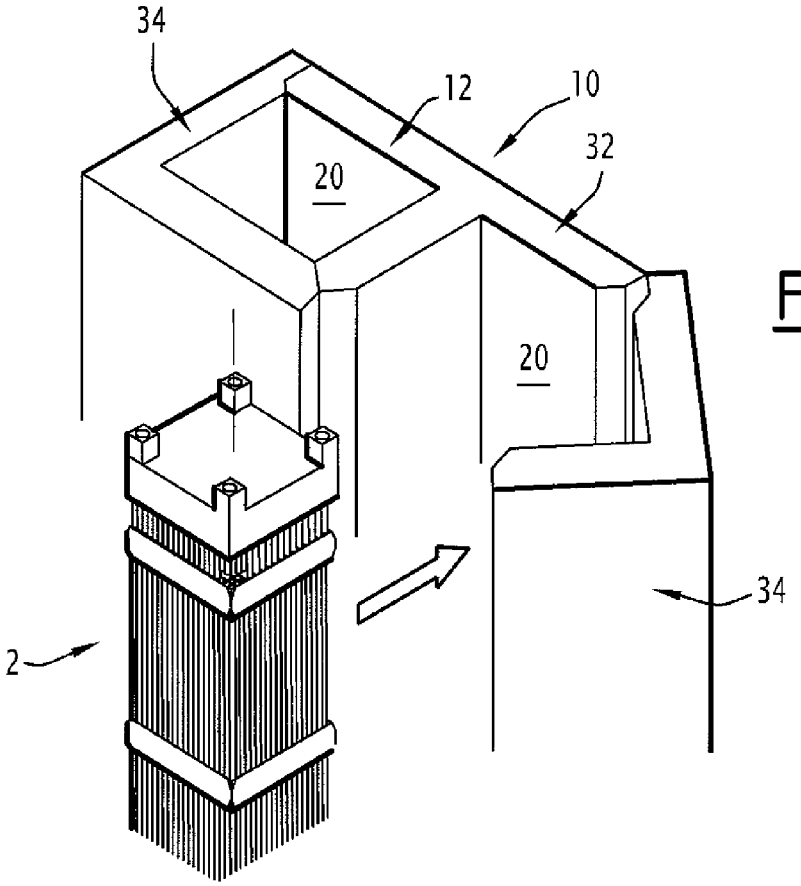

It is possible to load such a container in the manner illustrated in FIG. 6, from the top, or in the manner illustrated in FIG. 8, from the side. In order to do this, with the container 10 being placed in a vertical position and the upper lid 13 being withdrawn, a door 34 is opened to insert or withdraw the assembly 2.

That method of loading is more suitable when the height of the building is limited. In order to enable a door 34 to be opened when the container 10 is in the vertical position, it is provided that the lower lid 13 of the container 10 is not connected to the door 34 during the loading or unloading operation.

Figure 9:
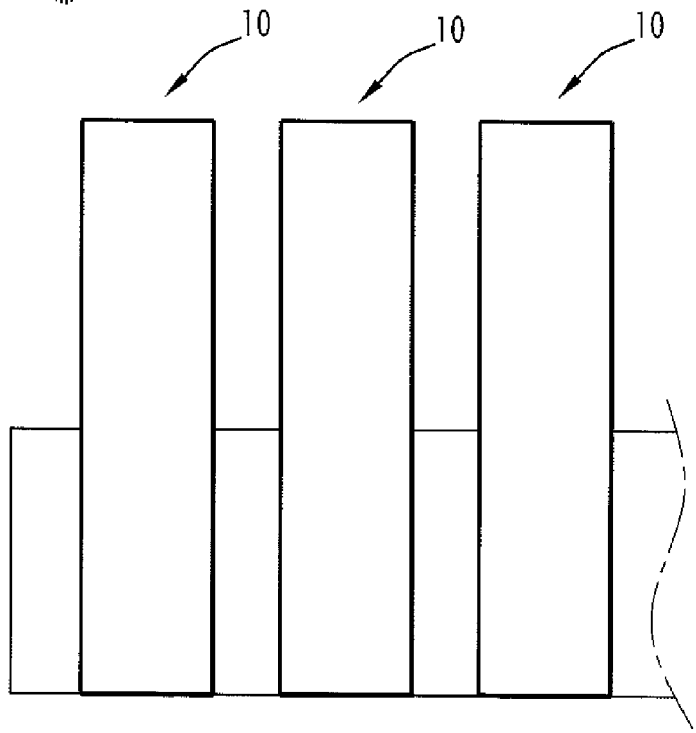
FIG. 9 is a diagrammatic view of a device for the intermediate storage of a container according to FIG. 2.

As shown in FIG. 9, it is possible to provide in a nuclear power station an intermediate storage device of the rack type, enabling a plurality of containers 10 to be stored intermediately in an upright position next to each other, with a particularly large space saving compared with storage in a horizontal position, and without a time limit. For, with a conventional container permitting storage only in the horizontal position, the duration of storage is limited in order to avoid damage to the assembly which is not designed to be stored horizontally.

The containers must ensure that, in the course of transport, the nuclear fuel assemblies are protected against impact, especially when accidents occur.

The fuel assembly transport containers must pass very strict qualification tests defined by international standards, such as the Regulations for the transport of radioactive material of the International Atomic Energy Agency (IAEA), the European Agreement concerning the international carriage of Dangerous goods by Road (ADR), the Regulations concerning the international carriage of dangerous goods by rail (RID), and the International Maritime Dangerous Goods (IMDG) Code.

In particular, the containers undergo especially a regulation drop test from a height of 9 m, with in general a first drop, the longitudinal direction of the container being in a vertical position, and a second drop, the longitudinal direction of the container being inclined relative to the horizontal by a predetermined value in order to cause the maximum damage and the inclination value being, for example, of the order of 15° in order to obtain a whipping effect, and a regulation drop test from a height of 1.5 m onto a punch, in the course of which tests the internal layer 22 must not open.

The casing 11 formed by the shell 12 and the lids 13 is suitable by itself for transporting non-irradiated nuclear fuel assemblies. In other words, it is capable by itself of protecting the nuclear fuel assemblies it contains in the course of transport, and in particular in the course of the regulation drop tests.

For, the multi-layered structure of the shell 12 confers on it a significant mechanical impact strength. The mechanical strength of the shell 12 is determined, among other things, by the following dimensions:

thickness of the metal sheets forming the metallic layers 22, 26, 30;

material and thickness of the insulating layer 24;

material and thickness of the protective layer 28;

material, shape, dimensions, number and position of the reinforcing members 31.

The thicknesses of the various layers and the nature thereof can be easily determined by the person skilled in the art on the basis of the characteristics of the fuel assemblies to be transported.

The nature and thickness of the insulating layer 24 will depend, for example, on the uranium 235 enrichment of the fissile material contained in the fuel rods 4. A criticality study will easily enable the most appropriate material and the necessary thickness to be determined: a sheet of hafnium a few hundredths to a few tenths of a mm thick or a sheet of boron aluminium or steel with a few percent of boron and a thickness of a few millimeters (for example from 1.5 to 4 mm) associated with a few centimeters of moderator material, such as polyethylene, equivalent to several centimeters (50 to 75 mm) of resin charged with a few percent of boron.

The thickness of the metal sheets 22, 26, 30 forming the metallic layers, and the material, shape, dimensions, number and position of the reinforcing members 31 will be determined, for example, by means of strength calculations in respect of the materials in order to avoid any deformation of the container and the transported assemblies and to ensure the necessary mechanical strength to pass the regulation tests successfully.

By way of example, the thicknesses of the metal sheets forming the metallic layers 22, 26, 30 and of any reinforcing members 31 provided in the form of bent metal sheets will advantageously be from 1 to 6 mm. Reinforcing members 31 in the form of an "I"-shaped beam may be, for example, in the range 80-140 according to Euronorm 19-57.

The protective layer 28 arranged on the outside protects against impact and prevents the insulating layer 24 from being affected and deformed excessively in the event of impact. Its thickness will advantageously be from 30 to 150 mm.

The insulating layer 24 absorbs the neutrons emitted by the fissile material and prevents them from being scattered outside the container 10.

All of the layers are grouped together as close as possible to the assemblies 2 received in the housings 20, without a gap between those layers. This makes it possible to limit the bulk and the mass of the container 10 by reducing the volume of material, to increase the resistance of the shell 12 to mechanical impact, and to limit the energy to be dissipated in the event of the container 10 falling.

The containers must also protect the nuclear assemblies in the event of a fire under normal transport conditions (undamaged container) but also under transport conditions after the occurrence of an accident (container damaged after a fall in accordance with the above-mentioned regulation tests).

In particular, the containers undergo a regulation fire resistance test in the course of which they have to withstand for 30 minutes a temperature of 850° C. brought about by a hydrocarbon fire.

The shell 12 and the lids 13 are capable by themselves of protecting nuclear fuel assemblies in the event of a fire.

The layered structure of the shell 12 ensures effective thermal protection in order to avoid an increase in temperature which could damage the assembly and its components.

The protective layer 28 is also configured to form a barrier against the propagation of heat from the outside to the inside of the shell 12.

Figure 12:
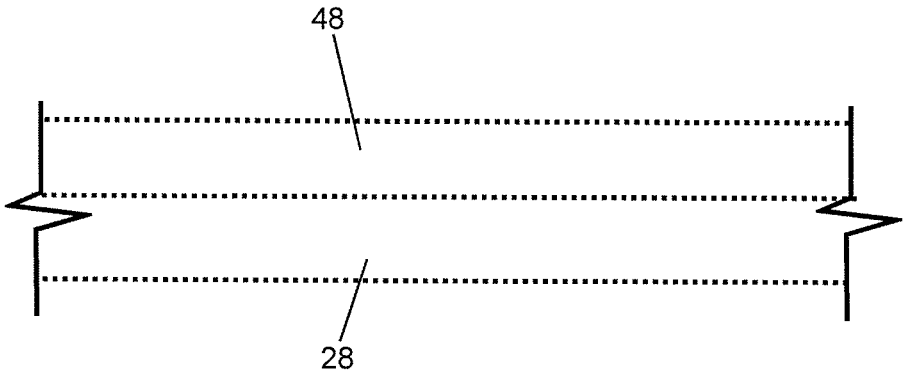
FIG. 12 is a schematic sectional view of an intermediate layer of the shell according to one alternative embodiment of the present invention.

In a variant, a specific thermal insulation layer is added between the metallic layers 26 and 30. FIG. 12 schematically shows a layer for thermal protection 48 added to the second intermediate layer 28.

Thus, the shell 12 and the lids 13 are capable by themselves of protecting the non-irradiated nuclear fuel assemblies in the various regulation tests to which the containers are subjected before being qualified for the road, rail, marine or air transport of non-irradiated nuclear fuel assemblies. It is not necessary to provide overpackaging.

The container 10 is particularly compact and light. As a result, its manipulation facilitated, as is its transport. A larger number of containers 10 can be placed on the same transport means, such as a lorry, a railway wagon or a marine or air container. The costs of transport and exploitation are therefore reduced.

The amount of neutron absorber and its presence as close as possible to the fuel assemblies also prevents any risk of starting a nuclear reaction between several containers 10 loaded, transported or stored together, without any limitation as to numbers.

As shown in FIG. 2, the container 10 comprises securing members for its manipulation, its lashing-down and its transport.

The container 10 comprises two tubular feet 52 secured transversely via a first face 16A of the external surface 16 of the container 10 to a reinforcing member 31. The feet 52 are configured to permit the engagement and the locking of securing members installed on the transport platform concerned (lorry, wagon, marine or air container) or on the container or the intermediate structure arranged below the container 10.

The container 10 comprises securing members 54 secured to a reinforcing member 31 via a second face 16B of the external container surface 16 opposite the first face. Those securing members 54 are to be secured to the feet of another container stacked on the container 10 or on an intermediate structure.

The container 10 comprises on the second face 16B, tubes 56 for receiving the forks of a lifting truck in order to enable the container to be lifted and placed on a lorry or a wagon. Those tubes 56 are arranged to receive handling tool securing members and also to permit the handling of the container by a suitable lifting means (rolling bridge, crane) and the vertical loading/unloading of the transport platform.

Figure 10:
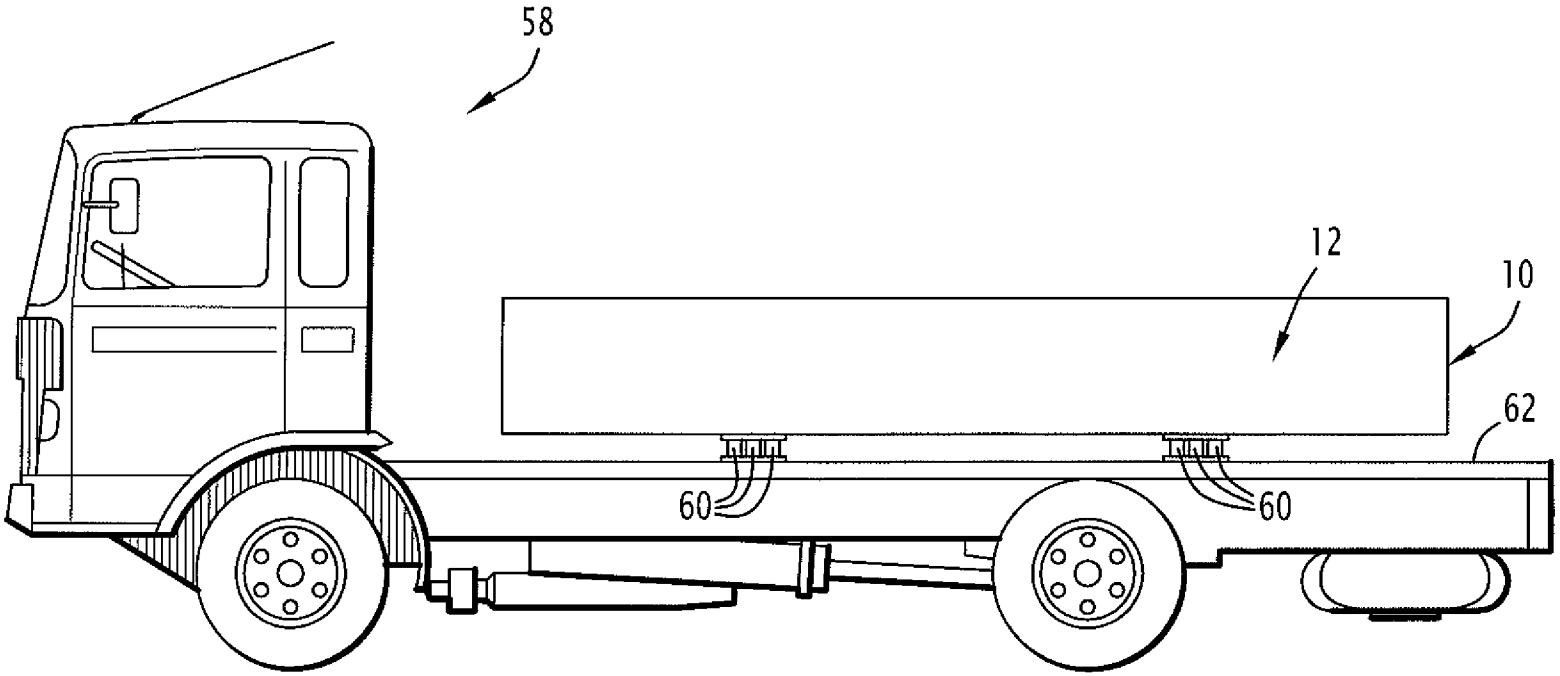
FIG. 10 is a diagrammatic side view of a vehicle transporting a container according to FIG. 2.

As illustrated in FIG. 10, according to one method of transport, at least one non-irradiated nuclear fuel assembly 2 is placed in the container 10, the container 10 is placed on a vehicle 58, in particular a road transport vehicle, and the container 10 is transported from a first site (for example a manufacturing site) to a second site (for example a nuclear power station) using, if necessary, intermodal means (road, rail, marine and/or air transport).

The container 10 is placed on the vehicle 58 in such a manner that the shell 12 protects the assemblies 2 by itself in the event of the container falling. Thus, no closed additional packaging and no overpackaging are arranged around the shell 12.

The impact strength of the container 10, which is conferred on it by the multi-layered structure of its shell 12, further enhanced by the protective layer 28, and the neutron insulation which is conferred on it by its insulating layer 24, enable it to be transported without overpackaging.

Furthermore, the assemblies have to be protected from vibration which could impair the support of the fuel rods 4 in the holding grids 8 or which could cause an axial displacement of the fuel pellet column and prevent or impair the later use of the assembly in a nuclear reactor.

The integrity of the nuclear fuel assembly can be preserved efficiently with a container 10 according to the invention, which comprises an internal layer 22 connected rigidly to an external layer 30, without suspension members, and in which each assembly 2 is held in a corresponding housing 20 purely owing to the small clearance between the assembly and the faces 40, 42 delimiting the housing 20.

It is possible to provide suspension members 60 between the transport platform 62 of the vehicle 58 and the container 10 in order to filter the vibration caused by transport. The suspension members 60 are, for example, simple elastomeric blocks.

It is also possible to provide suspension members between the container 10 and any deposit surface, whether this be another container or an intermediate structure located below the container 10 when the containers are stacked on the transport platform 62.

What is claimed is:

1. A transport container for at least one non-irradiated nuclear fuel assembly, comprising:

a casing for receiving the at least one nuclear fuel assembly, the casing being formed from an elongate tubular shell, the shell including a metallic internal layer delimiting at least one individual housing for receiving one assembly of the at least one nuclear fuel assemblies, and a metallic external layer surrounding the internal layer, the shell being filled between the internal layer of the shell and the external layer of the shell; and lids for closing the at least one individual housing at longitudinal ends of the shell;

wherein the at least one individual housing has a quadrangular cross-section defined by a first pair and a second pair of lateral faces each arranged in the shape of a V, the shell comprising for the at least one individual housing a support carrying the first pair of lateral faces arranged in the shape of a V, a door carrying the second pair of lateral faces arranged in the shape of a V, and a securing device securing the door to the support so as to enable the position of the door with respect to the support to be adjusted in a direction substantially parallel with a straight line passing through a vertex of the V defined by the first pair of lateral faces and a vertex of the V defined by the second pair of lateral faces.

2. The container according to claim 1 wherein the lateral faces are smooth over the entire length of the at least one individual housing.

3. A combination comprising:

the container according to claim 2; and at least one non-irradiated nuclear fuel assembly received in the casing, each of the at least one non-irradiated nuclear fuel assembly being in one of the at least one individual housing, wherein there is a transverse clearance between each of the lateral faces and corresponding surfaces of the at least one non-irradiated nuclear fuel assembly, the transverse clearance being to avoid damage to the one assembly caused by relative movement in the at least one individual housing.

4. The combination according to claim 3 wherein the transverse clearance is from 0.1 to 5 mm.

5. The combination according to claim 4 wherein the transverse clearance is from 0.3 to 3 mm.

6. The combination according to claim 4 wherein the transverse clearance is from 0.5 to 1 mm.

7. The container according to claim 1 wherein the shell comprises a first intermediate layer for neutrophage insulation and a second intermediate layer for protection against impact.

8. The container according to claim 7 wherein a layer for thermal protection is added to the second intermediate layer.

9. The container according to claim 7 wherein the second intermediate layer surrounds the first intermediate layer.

10. The container according to claim 7 wherein the shell has an intermediate metallic separation layer separating the first intermediate layer and the second intermediate layer.

11. The container according to claim 9 wherein the first intermediate layer and the second intermediate layer are formed of different materials than each other.

12. The container according to claim 11 wherein the second intermediate layer is formed by foam or by balsa wood.

13. The container according to claim 11 wherein the first intermediate layer is formed by a resin charged with a neutrophage chemical compound or element or a sheet of neutron-absorbing metallic material.

14. The container according to claim 13 wherein the first intermediate layer is formed by a resin which is charged with boron.

15. The container according to claim 13 wherein the first intermediate layer is formed by a sheet of hafnium.

16. The container according to claim 1 wherein the shell includes a second door, the support and the second door each having second inner surfaces formed by the metallic internal layer delimiting a second individual housing of the at least one individual housing.

17. A method of transporting at least one non-irradiated nuclear fuel assembly, the method comprising the following steps:

placing at least one non-irradiated nuclear fuel assembly in a container, the container being one according to claim 1, one non-irradiated nuclear fuel assembly of the at least one non-irradiated nuclear fuel assembly being supported by the internal layer in the one individual housing delimited by the internal layer, placing the container on a transport vehicle so that the casing of the container protects the at least one non-irradiated nuclear fuel assembly in the event of the container falling, and transporting the container from a first site to a second site.

18. The transport method according to claim 17 further comprising arranging suspension members between the shell and a deposit surface.

* * * * *